US006481652B2

(12) United States Patent
Strutz et al.

(10) Patent No.: US 6,481,652 B2
(45) Date of Patent: Nov. 19, 2002

(54) FOOD WASTE DISPOSER HAVING VARIABLE SPEED MOTOR AND METHODS OF OPERATING SAME

(75) Inventors: William A. Strutz, Racine, WI (US); Thomas R. Berger, Racine, WI (US); Scott W. Anderson, Racine, WI (US)

(73) Assignee: Emerson Electric Co., Racine, WI (US)

( * ) Notice: Subject to any disclaimer, the term of this patent is extended or adjusted under 35 U.S.C. 154(b) by 0 days.

(21) Appl. No.: 09/777,129

(22) Filed: Feb. 5, 2001

(65) Prior Publication Data

US 2002/0104907 A1 Aug. 8, 2002

Related U.S. Application Data

(60) Provisional application No. 60/253,481, filed on Nov. 28, 2000.

(51) Int. Cl.[7] ..... B02C 23/36
(52) U.S. Cl. ..... 241/46.013; 241/101.2
(58) Field of Search ..... 241/46.013, 101.2

(56) References Cited

U.S. PATENT DOCUMENTS

| | | | | |
|---|---|---|---|---|
| 2,495,983 | A | 1/1950 | Richards | 241/257 |
| 2,579,400 | A | 12/1951 | Schindler | 241/257 |
| 2,743,875 | A | 5/1956 | Brezosky et al. | 241/100.5 |

(List continued on next page.)

FOREIGN PATENT DOCUMENTS

| | | | |
|---|---|---|---|
| EP | 0 677 915 A1 | 10/1995 | H02K/23/54 |
| JP | 53047908 | 4/1978 | H02K/21/24 |
| JP | 58130759 | 8/1983 | H02K/23/54 |
| JP | 59101720 | 6/1984 | H01H/11/00 |
| JP | 60249859 | 12/1985 | H02K/29/00 |
| JP | 61161946 | 7/1986 | H02K/23/54 |
| JP | 61161947 | 7/1986 | H02K/23/54 |
| JP | 61161948 | 7/1986 | H02K/29/00 |
| JP | 2000050604 | 2/2000 | H02K/29/00 |
| JP | 2001-121021 A | 5/2001 | B02C/21/00 |
| WO | WO 00/64035 | 10/2000 | H02K/21/24 |

OTHER PUBLICATIONS

Appliance Manufactucture, "Novel Brushless DC Motors", Jan. 2001.
International Search Report for PCT Application No. PCT/US01/30279 dated Jan. 22, 2002.
International Search Report for PCT Application No.: PCT/US01/44609 mailed May 13, 2002.

*Primary Examiner*—William Hong
(74) *Attorney, Agent, or Firm*—Howrey Simon Arnold White, LLP

(57) ABSTRACT

The present invention provides a food waste disposer having an upper food conveying section, a motor section, a central grinding section and a controller. The upper food conveying section includes a housing forming an inlet to receive food waste. The motor section includes a switched reluctance machine having a rotor and a stator. The rotor imparts rotational movement to a rotatable shaft. The central grinding section is disposed between the food conveying section and the motor section. The food conveying section conveys food waste to the grinding section. The grinding section includes a grinding mechanism where a portion of the grinding mechanism is mounted to the rotatable shaft. The controller is electrically connected to the stator to control the switched reluctance machine. The controller is capable of directing rotational movement to the rotatable shaft and the portion of the grinding mechanism mounted to the rotatable shaft. The controller is further capable of maintaining the rotational movement of the rotatable shaft at more than one rotational speed. The present invention also includes methods of operating a variable speed motor in different operational modes such as soft start mode, optimized grinding mode, idle mode, rinse mode and anti-jamming mode.

55 Claims, 7 Drawing Sheets

U.S. PATENT DOCUMENTS

| | | | | |
|---|---|---|---|---|
| 2,782,997 | A | | 2/1957 | Wolff ..... 241/46 |
| 2,951,650 | A | | 9/1960 | Gould ..... 241/286 |
| 2,978,190 | A | | 4/1961 | Brucken et al. ..... 241/46 |
| 3,025,007 | A | | 3/1962 | Wieczorek ..... 241/100.5 |
| 3,443,764 | A | | 5/1969 | Wetzel ..... 241/46 |
| 3,534,913 | A | | 10/1970 | Lawrenson ..... 241/36 |
| 3,589,624 | A | | 6/1971 | Smith ..... 241/46.08 |
| 3,875,462 | A | | 4/1975 | Kiefer et al. ..... 317/13 R |
| 4,134,555 | A | | 1/1979 | Rosselet ..... 241/46 B |
| 4,187,441 | A | | 2/1980 | Oney ..... 310/112 |
| 4,373,676 | A | | 2/1983 | Sherman, Jr. ..... 241/36 |
| 4,526,518 | A | | 7/1985 | Wiernicki ..... 417/420 |
| 4,573,642 | A | | 3/1986 | Spelber ..... 241/46 B |
| 4,618,790 | A | | 10/1986 | Kakuda et al. ..... 310/90 |
| 4,633,149 | A | | 12/1986 | Welterlin ..... 318/254 |
| 4,665,286 | A | | 5/1987 | Hansen ..... 200/80 R |
| 4,776,523 | A | | 10/1988 | Hurst ..... 241/46 B |
| 4,793,561 | A | * | 12/1988 | Burda ..... 241/101.2 |
| 4,819,460 | A | | 4/1989 | Obradovic ..... 68/23.7 |
| 4,841,393 | A | | 6/1989 | MacLeod et al. ..... 360/98.07 |
| 4,888,512 | A | * | 12/1989 | Shimizu ..... 148/104 |
| 4,917,311 | A | | 4/1990 | Yoshino et al. ..... 241/36 |
| 4,998,052 | A | | 3/1991 | Erdman et al. ..... 318/701 |
| 5,111,096 | A | | 5/1992 | Horst ..... 310/168 |
| 5,129,590 | A | | 7/1992 | Shinya ..... 241/46.013 |
| 5,335,866 | A | | 8/1994 | Narao ..... 241/46.013 |
| 5,370,232 | A | | 12/1994 | Narao ..... 241/46.013 |
| 5,545,938 | A | | 8/1996 | Mecrow ..... 310/156 |
| 5,646,467 | A | | 7/1997 | Floresta et al. ..... 310/268 |
| 5,676,319 | A | | 10/1997 | Stiggins et al. ..... 241/46.012 |
| 5,687,918 | A | * | 11/1997 | Kubota et al. ..... 241/23 |
| 5,789,841 | A | | 8/1998 | Wang ..... 310/179 |
| 5,866,965 | A | | 2/1999 | Baronosky et al. ..... 310/208 |
| 5,897,066 | A | * | 4/1999 | Bacon et al. ..... 241/160 |
| 5,982,069 | A | | 11/1999 | Rao ..... 310/208 |
| 6,007,006 | A | | 12/1999 | Engel et al. ..... 241/46.014 |
| 6,014,003 | A | | 1/2000 | French ..... 318/701 |
| 6,051,942 | A | | 4/2000 | French ..... 318/254 |
| 6,239,530 | B1 | | 5/2001 | Garcia ..... 310/216 |
| 6,259,233 | B1 | | 7/2001 | Caamaño ..... 322/89 |

* cited by examiner

FOOD WASTE DISPOSER HAVING VARIABLE SPEED MOTOR AND METHODS OF OPERATING SAME

CROSS REFERENCE TO RELATED APPLICATIONS

This application claims the benefit of U.S. Provisional Application No. 60/253,481 filed on Nov. 28, 2000, which is incorporated by reference in its entirety. This application is related to application Ser. No. 09/777,126 entitled "Switched Reluctance Machine and Food Waste Disposer Employing Switched Reluctance Machine" by Strutz, filed concurrently herewith, the disclosure of which is incorporated herein by reference in its entirety.

FIELD OF THE INVENTION

The present invention relates generally to food waste disposers and, more particularly, to a food waste disposer having a variable speed motor such as a switched reluctance machine.

BACKGROUND OF THE INVENTION

The fineness and duration of grinding food waste are important considerations in the design and operation of a disposer. Many conventional food waste disposers use a single speed induction motor that rotates a grinding plate to grind food waste. The rotational speed of the grinding plate for most food waste disposers is between 1700 and 1800 rotations per minute (RPM). A food waste disposer having an induction motor is disclosed in U.S. Pat. No. 6,007,006 (Engel et al.), which is owned by the assignee of the present application and incorporated herein by reference in its entirety.

It has been found that the selected rotational speed of the grinding plate may affect the grind performance of the disposer for certain types of foods. For example, harder food particles such as carrot fragments and bone fragments may "ride" on the grinding plate at high rotational speeds. Riding occurs when food particles rotate at the same speed as the grinding plate without being ground. Riding results in increased noise and vibration, as well as, residual food left in the grinding chamber after the disposer is turned off. Over time, residual food may cause unpleasant odors. Thus, a need exists for a food waste disposer having a mechanism to ensure all food is removed from the grind chamber.

Reduced flow in drain pipes is another important consideration in the design of a food waste disposer. A grinding chamber of a food disposer may be filled with food before the disposer is turned on by the user. For example, a user may fill the grinding chamber with potato peels before activating the disposer. When the conventional food waste disposer is turned on and immediately directed to a high rotational speed, a large slug of food may be forced down the discharge or drainpipe. This may reduce drain flow. Thus, a food waste disposer is needed that can prevent a large slug of food waste from being forced down the drainpipe during startup.

Another area of concern with conventional disposers is noise and power consumption. The typical rotational speed of the grinding plate for conventional disposers is fixed at a relatively high speed. Higher rotational speeds may produce more noise and consume more power. There may be times where the disposer is not grinding food but still turned on and running. For example, if a user is cleaning off the dinner table, there may be times when the disposer is running but no food is in the disposer. It would be beneficial to reduce the speed caused during periods of inactivity. Thus, there is a need for a disposer that reduces speed and power consumption during times of inactivity.

A further problem in designing a food waste disposer is jamming. Food waste in a conventional food waste disposer is forced by lugs on a rotating grinding plate against teeth of a stationary shredder ring. Jamming occurs when hard objects such as bones enter the food waste disposer and get stuck between the lugs of the rotating grinding plate and the stationary shredder ring. The prior art has tried to solve jamming by using motors that can be manually switched to rotate in the opposite direction. There is a need, however, for a food waste disposer that can automatically correct itself if a jam has occurred.

The present invention is directed to overcoming, or at least reducing the effects of, one or more of the conditions set forth above.

SUMMARY OF THE INVENTION

To that end, the present invention provides a food waste disposer having an upper food conveying section, a motor section, a central grinding section and a controller. The upper food conveying section includes a housing forming an inlet to receive food waste. The motor section includes a switched reluctance machine having a rotor and a stator. The rotor imparts rotational movement to a rotatable shaft. The central grinding section is disposed between the food conveying section and the motor section. The food conveying section conveys food waste to the grinding section. The grinding section includes a grinding mechanism where a portion of the grinding mechanism is mounted to the rotatable shaft. The controller is electrically connected to the stator to control the switched reluctance machine. The controller is capable of directing rotational movement to the rotatable shaft and the portion of the grinding mechanism mounted to the rotatable shaft. The controller is further capable of maintaining the rotational movement of the rotatable shaft at more than one rotational speed and direction.

The grinding mechanism of the food waste disposer may include a shredder plate assembly and a stationary shredder ring. In such an embodiment, the shredder plate assembly is the portion of the grinding mechanism mounted to the rotatable shaft. The shredder plate assembly may include fixed grinding lugs or moveable lugs.

In a further embodiment, the present invention includes a food waste disposer having an upper food conveying section, a motor section, a central grinding section, and a controller. The motor section includes a variable speed motor having a rotor and a stator. The rotor imparts rotational movement to a rotatable shaft that turns a portion of a grinding mechanism that is located in the central grinding section. The controller is electrically connected to the stator to control the variable speed motor. The controller is capable of operating in a variety of modes including soft start mode, optimized grinding mode, idle mode, rinse mode, and anti-jamming mode. For example, in one embodiment of the soft start mode, the controller is capable of activating the variable speed motor at startup to rotate a portion of the grinding mechanism mounted to the rotatable shaft and slowly increase the rotational speed of the portion of the grinding mechanism to a predetermined rotational rate over a predetermined period of time. In one embodiment of the optimized grinding mode, the controller is capable of rotating the portion of the grinding mechanism mounted to the rotatable shaft at a first rotational speed during a first period of time and rotating the portion of the grinding mechanism at a second rotational speed during a second period of time. In one embodiment of the idle mode, the controller is capable of rotating the portion of the grinding mechanism mounted to the rotatable shaft at a first rotational speed. The controller is further capable of determining whether food waste has entered the food waste disposer and increasing the first rotational speed to a second rotational speed if food waste has entered the food waste disposer. In one embodiment of the rinse mode, the controller is capable of rotating the portion of the grinding mechanism mounted to the rotatable shaft at a first rotational speed and increasing the first rotational speed to a second rotational speed during a period of time when water is introduced into the disposer. In this embodiment, the second rotational speed is greater than the first rotational speed. In one embodiment of the anti-jamming mode, the controller is capable of rotating the portion of the grinding mechanism mounted to the rotatable shaft at a first rotational speed and a first torque. The controller is further capable of determining whether food waste is jammed in the grinding mechanism by monitoring the current and speed provided to the variable speed motor and increasing the first torque to a second torque if it is determined that such a jam is about to occur or has occurred.

In another embodiment, the present invention includes various methods of operating a food waste disposer having a variable speed motor. The variable speed motor may be a switched reluctance machine or another type of variable speed motor. The operational methods include soft start mode, optimized grinding mode, idle mode, rinse mode, and anti-jamming mode. For example, in soft start mode there is a method for reducing a slug of food waste into a drainpipe by a food waste disposer. The food waste disposer has a variable speed motor, a rotatable shaft and a grinding mechanism. The variable speed motor imparts rotational movement to the rotatable shaft and a portion of the grinding mechanism that is mounted to the rotatable shaft. The method includes the steps of: activating the variable speed motor at startup to rotate the portion of the grinding mechanism that is mounted to the rotatable shaft; and slowly increasing the rotational speed of the portion of the grinding mechanism mounted to the rotatable shaft to a predetermined rotational rate over a predetermined period of time. The portion of the grinding mechanism mounted to the rotatable shaft may be a shredder plate assembly.

In an optimized grinding mode, there is a method of operating a food waste disposer having a variable speed motor, a rotatable shaft and a grinding mechanism. The variable speed motor imparts rotational movement to the rotatable shaft and a portion of the grinding mechanism that is mounted to the rotatable shaft. The method includes the steps of: rotating the portion of the grinding mechanism mounted to the rotatable shaft at a first rotational speed during a first period of time; and rotating the portion of the grinding mechanism mounted to the rotatable shaft at a second rotational speed during a second period of time. The second rotational speed is less than the first rotational speed. Moreover, the second period of time is after the first period of time. The first rotational speed may be between 2500 and 4000 rotations per minute. The second rotational speed is less than 2500 rotations per minute.

The method for operating in an optimized grinding mode may further include the step of rotating the portion of the grinding mechanism mounted to the rotatable shaft at a third rotational speed during a third period of time. The third rotational speed being less than the second rotational speed. The third rotational speed may be between 100 and 1500 rotations per minute.

In an idle mode, there is a method of operating a food waste disposer having a variable speed motor, a rotatable shaft and a grinding mechanism. The variable speed motor imparts rotational movement to the rotatable shaft and a portion of the grinding mechanism that is mounted to the rotatable shaft. The method includes the steps of: rotating the portion of the grinding mechanism mounted to the rotatable shaft at a first rotational speed; determining whether food waste has entered the food waste disposer; and increasing the first rotational speed to a second rotational speed if food waste has entered the food waste disposer. The first rotational speed may be between 400 and 800 rotations per minute although other relatively lower rotational speeds may be used.

The method for operating in idle mode may further include the steps of: determining whether food waste has exited the food waste disposer after increasing the first rotational speed to a second rotational speed; and decreasing the second rotational speed to the first rotational speed if food waste has exited the food waste disposer.

In a rinse mode, there is a method of operating a food waste disposer having a variable speed motor, a rotatable shaft, and a grinding mechanism. The variable speed motor imparts rotational movement to the rotatable shaft and a portion of the grinding mechanism that is mounted to the rotatable shaft. The method includes the steps of: rotating the portion of the grinding mechanism mounted to the rotatable shaft at a first rotational speed; entering water into the food waste disposer; and increasing the first rotational speed to a second rotational speed while entering water into the food waste disposer, the second rotational speed greater than the first rotational speed. The first rotational speed may be between 400 and 800 rotations per minute and the second rotational speed may be greater than 1500 rotations per minute. The entering of water may be through the same inlet as the food waste inlet or may be a separate means that automatically injects water into the disposer.

In the anti-jamming mode, there is a method of operating a food waste disposer having a variable speed motor, a rotatable shaft, and a grinding mechanism. The variable speed motor imparts rotational movement to the rotatable shaft and a portion of the grinding mechanism that is mounted to the rotatable shaft. The method includes the steps of: rotating the portion of the grinding mechanism mounted to the rotatable shaft at a first rotational speed and a first torque; determining whether food waste is jammed in the grinding mechanism by monitoring the current provided to the variable speed motor; and increasing the first torque to a second torque if it is determined that food waste is jammed in the grinding mechanism. Additionally, if it is determined that food waste is jammed, the rotation of the grinding mechanism may be reversed or, alternatively, a series of quick backward and forward rotations may be performed.

The method for operating in anti-jamming mode may further include the steps of: stopping the rotation of the portion of the grinding mechanism mounted to the portable shaft; and rotating the portion of the grinding mechanism mounted to the rotatable shaft in an opposite direction. Additionally, if it is determined that a jam exists, the rotatable shaft may be instructed to perform a series of quick backward and forward rotations to dislodge the jammed object.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings.

Figure 1:
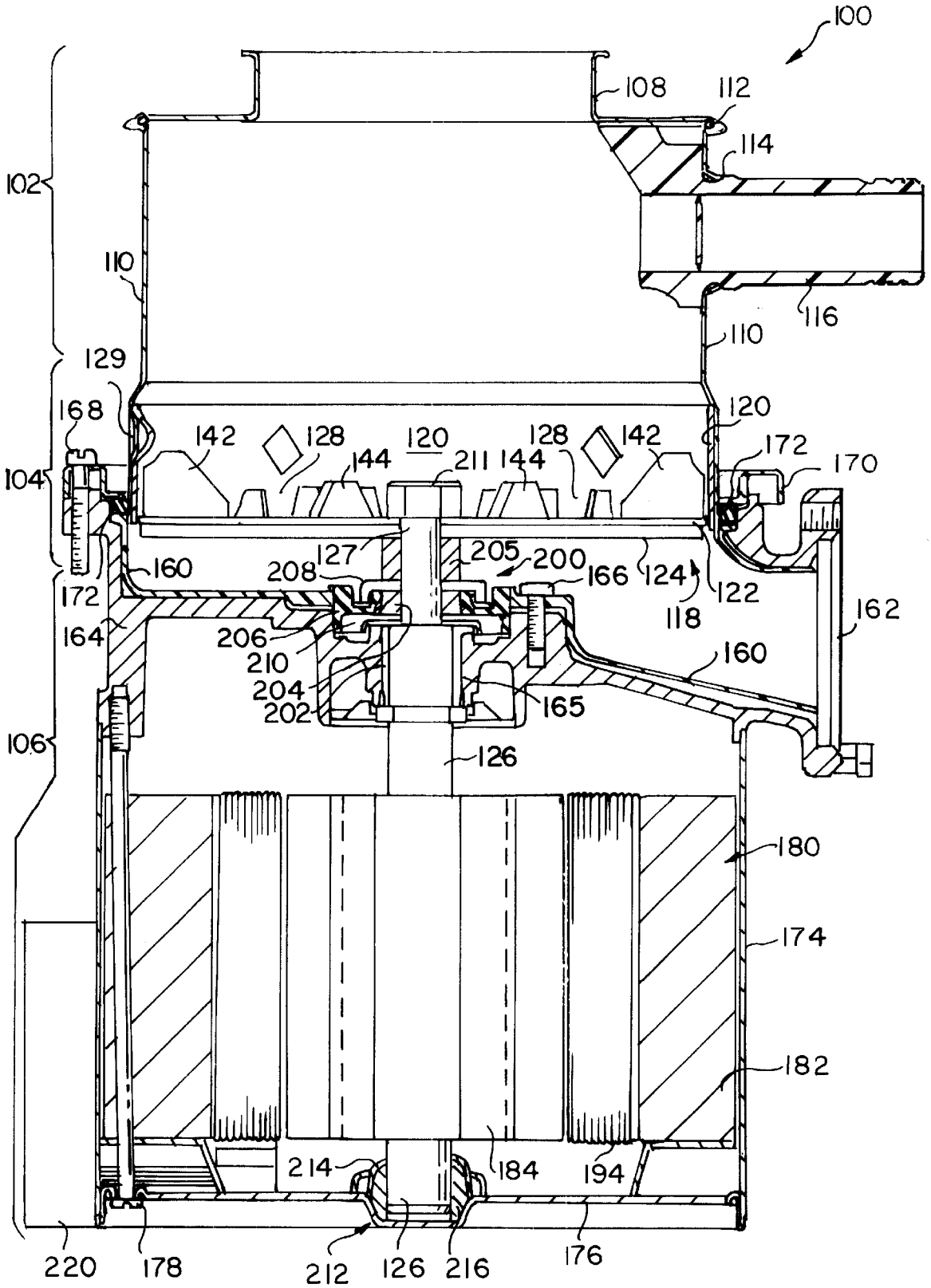
FIG. 1 is a cross-sectional view of a food waste disposer embodying the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF PREFERRED EMBODIMENTS

Turning to the drawings, FIG. 1 depicts a food waste disposer 100 embodying the present invention. The disposer 100 may be mounted in a well-known manner in the drain opening of a sink using conventional mounting members of the type disclosed in U.S. Pat. No. 3,025,007, which is owned by the assignee of the present application and incorporated herein by reference in its entirety. The disposer includes an upper food conveying section 102, a central grinding section 104 and a variable speed motor section 106. The central grinding section 104 is disposed between the food conveying section 102 and the variable speed motor section 106.

The food conveying section 102 conveys the food waste to the central grinding section 104. The food conveying section 102 includes an inlet housing 108 and a conveying housing 110. The inlet housing 108 forms an inlet at the upper end of the food waste disposer 100 for receiving food waste and water. The inlet housing 108 is attached to the conveying housing 110. A rubber o-ring 112 may be used between the inlet housing 108 and conveying housing 110 to prevent external leaks. A sealant bead may also be used instead of the rubber o-ring 112. The sealant bead is preferably composed of a tacky, malleable material that fills any voids between the inlet housing 108 and the conveying housing 110 and tempers any irregularities in the opposing surfaces of the housings. Some suitable malleable materials for the sealant bead include butyl sealant, silicone sealant, and epoxy.

The conveying housing 110 has an opening 114 to receive a dishwasher inlet 116. The dishwasher inlet 116 is used to pass water from a dishwasher (not shown). The inlet housing 108 and conveying housing 110 may be made of metal or injection-molded plastic. Alternatively, inlet housing 108 and conveying housing 110 may be one unitary piece.

The central grinding section 104 includes a grinding mechanism having a shredder plate assembly 118 and a stationary shredder ring 120. In one embodiment, the shredder plate assembly 118 may include an upper rotating plate 122 and a lower lug support plate 124. The upper rotating plate 122 and lower lug support plate 124 are mounted to a rotatable shaft 126 of the variable speed motor section 106. A portion of the conveying housing 110 encompasses the grinding mechanism. The grinding mechanism shown in FIG. 1 is a fixed lug grinding system. Although a fixed lug grinding system is preferred in the current invention, the present invention is not limited to fixed lug grinding systems. Alternatively, the present invention could use a moveable lug assembly such as that disclosed in U.S. Pat. No. 6,007,006 (Engel et al.).

The shredder ring 120, which includes a plurality of spaced teeth 128, is fixedly attached to an inner surface of the conveying housing 110 by an interference fit and is preferably composed of stainless steel but may be made of other metallic material such as galvanized steel. As shown in FIG. 1, ramps 129 formed on the inside wall of the housing 110 may also be used to retain the shredder ring 120 in the housing 110.

Figure 2:
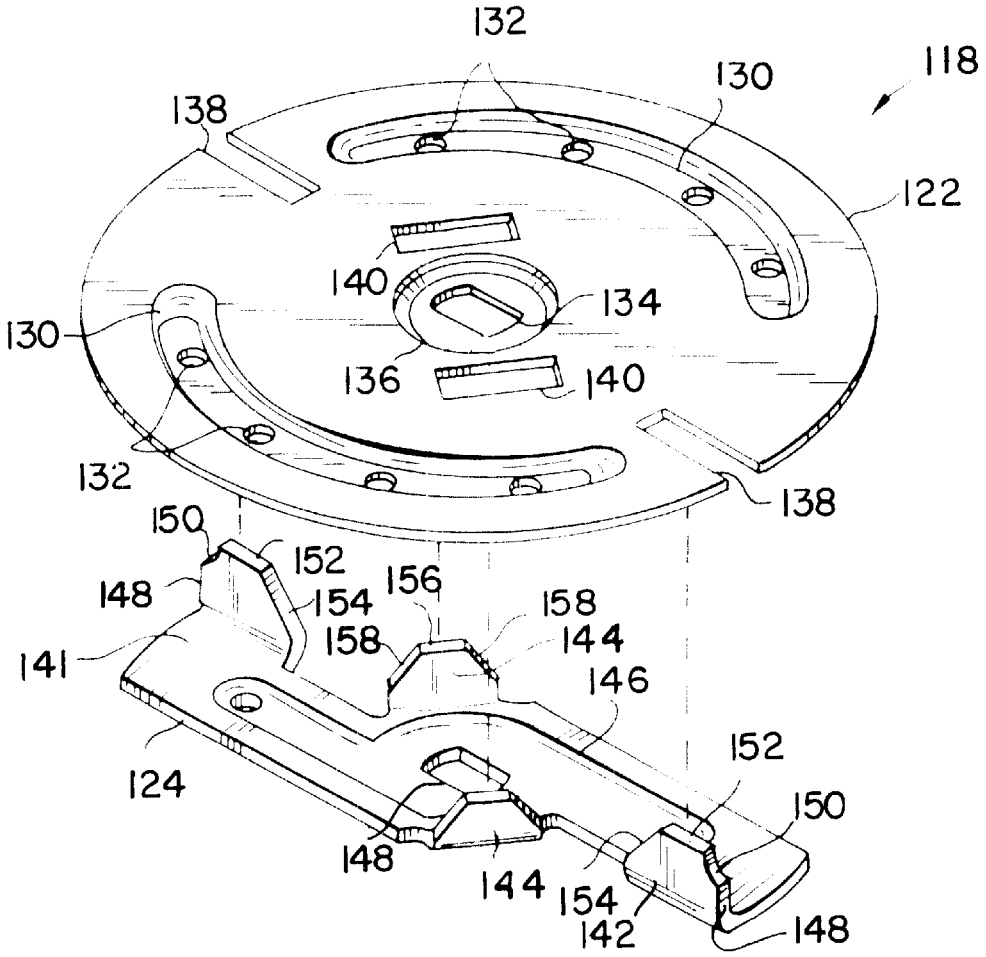
FIG. 2 is a perspective view of the shredder plate assembly of the grinding mechanism for the present invention.

As seen in FIG. 2, the upper rotating plate 122 and lower lug support plate 124 are engaged to form the shredder plate assembly 118. It is preferred that the shredder plate assembly 118 comprise of two engaged components. This reduces the complexity of the manufacturing process and increases the integrity of the grinding mechanism. The upper rotating plate 122 and lower support plate 124, alternatively, may be attached by mechanical means (such as welds or rivets) or by an adhesive known by those skilled in the art. Attaching the components reduces relative movement between the two components and minimizes the number of parts to be handled during final assembly. In another embodiment, the shredder plate assembly 118 may be comprised of a single unitary component that comprises a rotating plate, fixed grinding lugs and tumbling spikes. The fixed grinding lugs and tumbling spikes are mounted on the rotating plate or formed as an integral part of the rotating plate.

The upper rotating plate 122 provides a platform, or table, that holds the food waste so that the food waste may be ground. The upper rotating plate 122 may include two strengthening ribs 130 that are preferably disposed concentric to the periphery of the upper rotating plate 122. Inside the strengthening ribs 122, the upper rotating plate 122 includes a plurality of drain holes 132. FIG. 2 shows one embodiment having four drain holes 132 inside each strengthening rib 130. The upper rotating plate 122 also has a mounting hole 134 to mount the upper rotating plate 122 to the rotatable shaft 126. The mounting hole 134 is preferably in the shape of a double D to assist in transmitting the torque from the rotatable shaft 126. The upper rotating plate 122 may also include a strengthening circle 136 to provide further support to the mounting hole 134. To allow the lower lug support plate 124 to engage the upper rotating plate 122, the upper rotating plate 122 includes key slots 138 and key holes 140.

The upper rotating plate 122 may be formed from a flat sheet of metal that is stamped into shape. Alternatively, the upper rotating plate 122 may be formed by powdered metal methods, by injection molding methods such as insert plastic injection molding or metal injection molding, or by casting methods such as die-casting or investment casting. The upper rotating plate 122 preferably may have a thickness ranging from about 0.040 inch to about 0.100 inch thick. In a preferred embodiment, the upper rotating plate 122 is composed of double-sided galvanized cold-rolled steel and has a thickness of about 0.071 inch.

In one embodiment, the lower lug support plate 124 includes a body portion 141, two fixed shredder lugs 142, and two fixed tumbling spikes 144. The shredder lugs 142 preferably have a vertical toe 148, a curved notch 150, a top 152, and a sloped heel 154. The slope of the heel 154 decreases inwardly toward the center of the lower lug support plate 124. The tumbling spikes 144 preferably have a top 156 and downwardly slanted sides 158. The body portion 141 of the lower lug support plate 124 preferably includes a strengthening rib 146 that runs nearly the full length of the lower lug support plate 124. The lower lug support plate 124 includes a mounting hole 148 to mount the lower lug support plate 124 to the rotatable shaft 126. The mounting hole 148 is preferably in the shape of a double D to assist in transmitting the torque from the rotatable shaft 126.

The lower lug support plate 124 may be formed from a flat strip or sheet of metal that is stamped into shape. Like the upper rotating plate 122, the lower lug support plate 124 may also be formed by powdered metal methods, by injection molding methods such as insert plastic injection molding or metal injection molding, or by casting methods such as die-casting or investment casting. The lower lug support plate 124 preferably may have a thickness ranging from about 0.090 inch to about 0.190 inch thick. In a preferred embodiment, the lower lug support plate 124 is composed of stainless steel and has a thickness of about 0.125 inch thick. If stamping methods are used, the shredder lugs 142 and tumbling spikes 144 may be formed by folding portions of the stamped metal upward. In this way, the shredder lugs 142 and tumbling spikes 144 are an integral part of the lower lug support plate 124. After forming the shredder lugs 142 and the tumbling spikes 144, the lug support plate 124 is preferably heat treated by methods known by those skilled in the art. Other types of suitable fixed lug designs are disclosed in patent application Ser. No. 09/524,853 (filed Mar. 14, 2000), entitled "Grinding Mechanism For A Food Waste Disposer And Method Of Making The Grinding Mechanism," by Scott W. Anderson, et al., which is owned by the assignee of the present application and incorporated herein by reference in it entirety.

Referring back to FIG. 1, in the operation of the food waste disposer, the food waste delivered by the food conveying section 102 to the grinding section 104 is forced by the lugs 142 on the shredder plate assembly 118 against the teeth 128 of the shredder ring 120. The sharp edges of the teeth 128 grind or comminute the food waste into particulate matter sufficiently small to pass from above the upper rotating plate 122 to below the plate via gaps between the teeth 128 outside the periphery of the plate 122. Due to gravity and water flow, the particulate matter that passes through the gaps between the teeth 128 drops onto a plastic liner 160 and, along with water entering into the disposer 100 via the inlet to the inlet housing 108, is discharged through a discharge outlet 162 into a tailpipe or drainpipe (not shown). To direct the mixture of particulate matter and water toward the discharge outlet 162, the plastic liner 160 is sloped downward toward the periphery side next to the discharge outlet 162. The discharge outlet 162 may be formed as part of a die-cast upper end bell 164. Alternatively, the discharge outlet 162 may be separately formed from plastic as part of the outer housing of the disposer. The outer surface of the discharge outlet 164 allows a tailpipe or drainpipe to be connected to the discharge outlet 162.

The plastic liner 160 is attached to the die-cast upper end bell 164 by screws or bolts 166. The upper end bell 164 is attached to the conveying housing 110 by screws or bolts 168. To prevent external leaks, a ring bracket 170 and o-ring or sealer 172 may be used to secure the connection between the conveying housing 110 and the upper end bell 164.

The upper end bell 164 is used to separate the central grinding section 104 and the variable speed motor section 106. The variable speed motor section 106 is housed inside a housing 174 and a lower end frame 176. The housing 174 may be formed from sheet metal and the lower end frame 176 may be formed from stamped metal. The housing 174 and lower end frame 176 are attached to the upper end bell 164 by screws or bolts 178.

It has been found, through the present invention, that many of the problems of the prior art may be overcome by using a variable speed motor. One suitable variable speed motor is a switched reluctance machine that may be obtained from Emerson Appliance Motors in St. Louis. An example of a switched reluctance machine and a suitable control for a switched reluctance machine is further described in U.S. Pat. Nos. 6,014,003 and 6,051,942, which are owned by the assignee of the present invention and incorporated herein by reference in their entirety. Another suitable type of switched reluctance machine is disclosed in application Ser. No. 09/777,126 entitled "Switched Reluctance Machine and Food Waste Disposer Employing Switched Reluctance Machine" by Strutz, filed concurrently herewith and owned by the assignee of the present invention, the disclosure of which is incorporated herein by reference in its entirety. The present invention may also include other motors that are modified for variable speed by adding a controller. Such motors may include universal motors, permanent magnet motors or induction motors.

In one embodiment, the variable speed motor section 106 includes a switched reluctance machine 180 having a stator 182 and a rotor 184. The rotor imparts rotational movement to the rotatable shaft 126. The switched reluctance machine 180 is enclosed within the housing 174 extending between the upper and lower end frames 164 and 176. Although the description of the current invention is in the context of a switched reluctance machine, the present invention is applicable to other forms of variable speed motors and machines that control and operate the rotation of the shaft at different rotational speeds.

Figure 3:
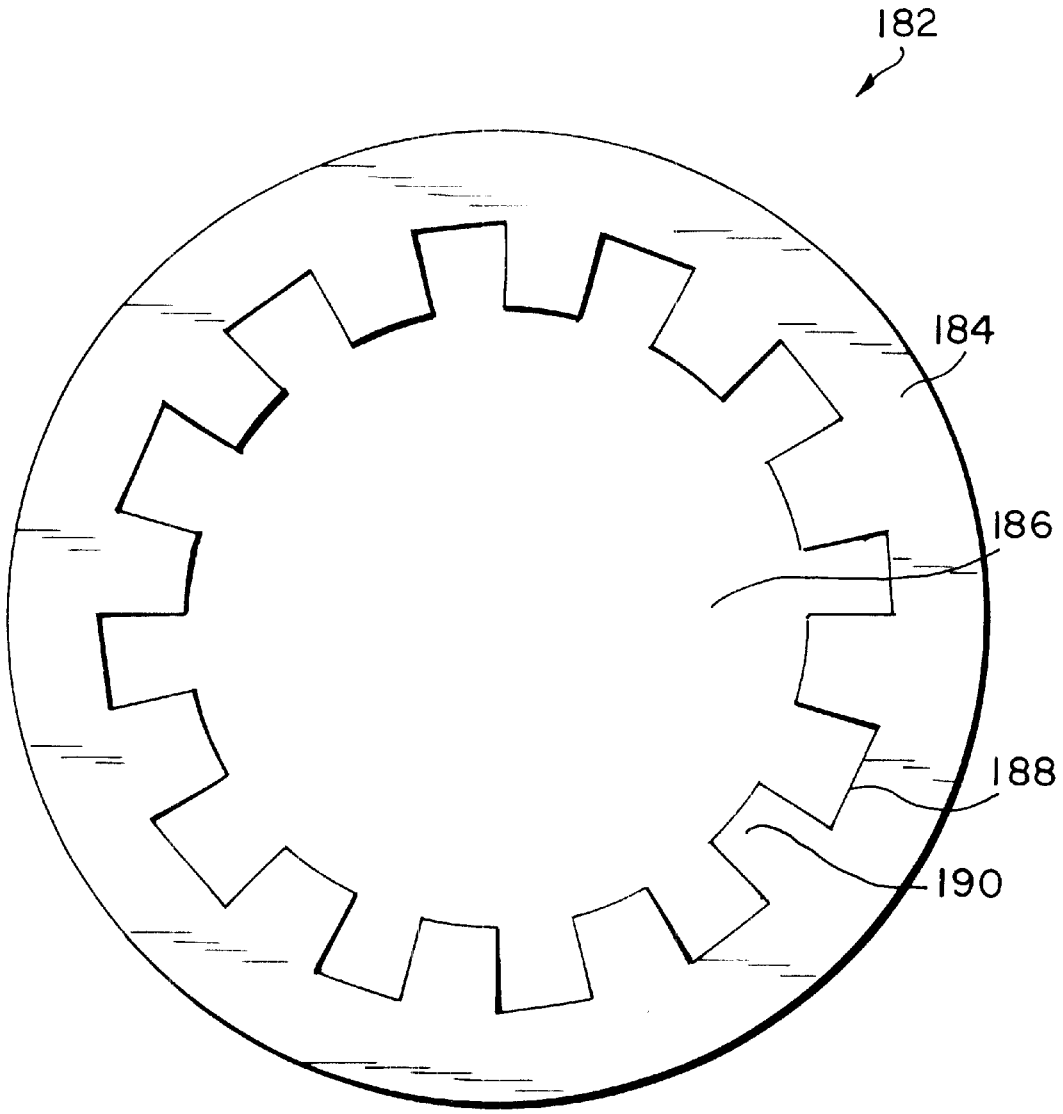
FIG. 3 is a top view of the stator for the switched reluctance machine of the present invention.
Figure 4:
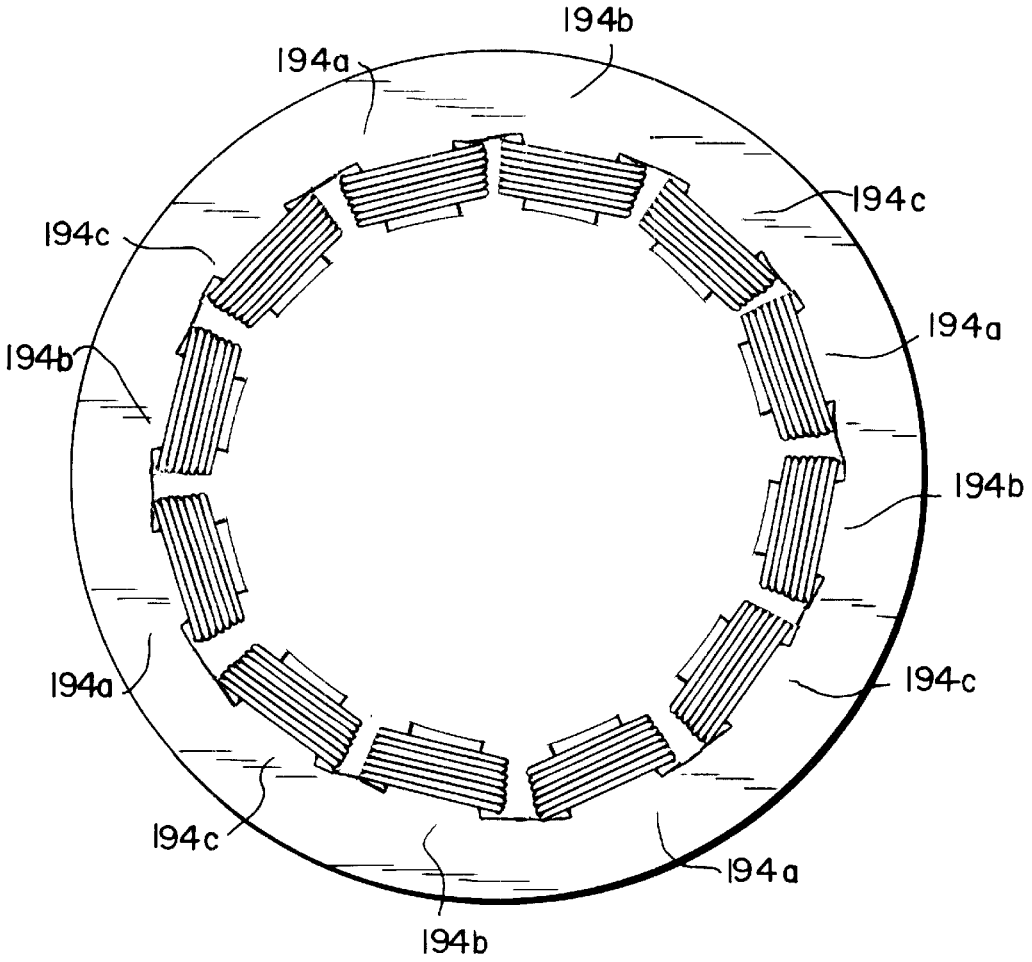
FIG. 4 is a top view of the stator in FIG. 3 with coiled windings.

As shown in FIGS. 1 and 3, the stator 182 has a circular body 184 and a hollow core area 186. The hollow core area is defined by a bore 188 having inwardly projecting salient poles 190. Each salient pole 190 of the stator 182 has a coil of wire 194 wound around the pole 190. In one embodiment, the stator 182 has twelve stator poles for three phases of operation. Thus, every third stator pole 190 is electrically connected together so that each phase is performed by energizing a set of four stator poles 190. This is illustrated in FIG. 4 by coils 194*a,* 194*b* and 194*c*. Each phase energizes a set of four stator poles 190 that define a cross.

Figure 5:
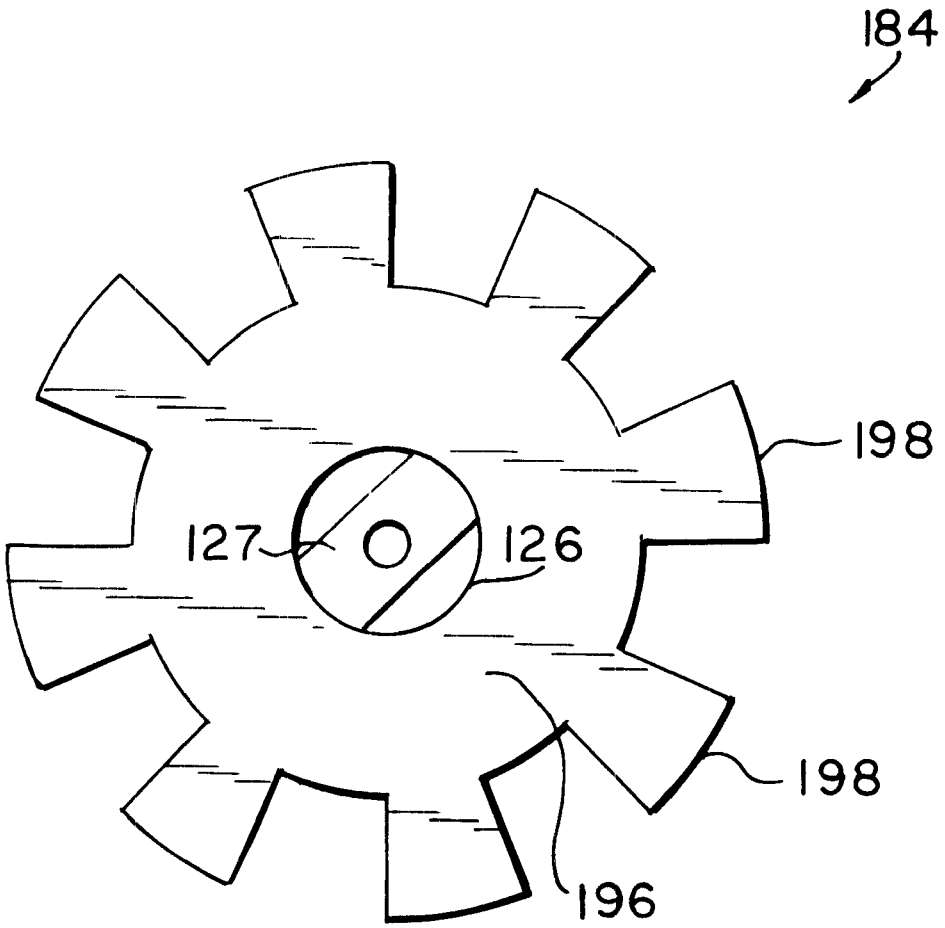
FIG. 5 is a top view of the rotor and shaft for the switched reluctance machine of the present invention.

As shown in FIGS. 1 and 5, the rotor 184 has a circular body 196 and externally projecting salient poles 198. The rotor 184 is sized to set within the hollow core area 186 of the stator 182. As explained in more detail below, as each phase of the coil windings 194*a,* 194*b,* and 194*c* is activated, the rotor 184 rotates within the hollow core area 186 of the stator 182. In this embodiment, the rotor 184 has eight poles 198.

Reluctance torque is developed in a reluctance machine by energizing each set of coils 194. Each set of coils 194 are energized when the corresponding stator poles 190 and rotor poles 198 are in a position of misalignment. The degree of misalignment between the stator poles 190 and the rotor poles 198 is called the phase angle. Energizing a pair of coils 194 creates magnetic north and south poles. Because the pair of rotor poles 198 is misaligned with the energized stator poles 190 by some phase angle, the inductance of the stator 182 and rotor 184 is less than maximum. The rotor poles 198 will tend to move to a position of maximum inductance with the energized windings. The position of maximum inductance occurs where the rotor and stator poles are aligned.

At a certain phase angle in the rotation of the rotor poles 198 to the position of maximum inductance, but before the position of maximum inductance is achieved, the current is removed from the phase by de-energizing the energized set of coils 194. Subsequently, or simultaneously, a second phase is energized, creating new magnetic north and south poles in a second set of stator poles. If the second phase is energized when the inductance between the second set of stator poles and the rotor poles is increasing, positive torque is maintained and the rotation continues. Continuous rotation is developed by energizing and de-energizing different sets of coils 194 in this fashion. The total torque of a reluctance machine is the sum of the individual torques described above.

Referring back to FIG. 1, as described earlier, the upper end bell 164 separates the grinding section 104 from the variable speed motor section 106. The upper end bell 164 may dissipate the heat generated by the switched reluctance machine 180, prevents particulate matter and water from contacting the switched reluctance machine 180, and directs the mixture of particulate matter and water to the discharge outlet 162.

To align the rotatable shaft 126 and, at the same time, permit rotation of the rotatable shaft 126 relative to the upper end bell 164, the upper end bell 164 has a central bearing pocket 165 that houses a bearing assembly 200. In one embodiment, the bearing assembly 200 encompasses the rotatable shaft 126 and comprises a sleeve bearing 202, a sleeve 204, a spacer 205, a rubber seal 206, a slinger 208 and a thrust washer 210. The sleeve bearing 202 is pushed into the smaller portion of the central bearing pocket 165. The sleeve bearing 202 is preferably made of powdered metal having lubricating material. The thrust washer 210 is placed on top of the bearing 202. The steel sleeve 204 encompasses the rotatable shaft 126 and is positioned above the thrust washer 210 and sleeve bearing 202. The steel sleeve 204 resides on an upper end portion 127 of the rotatable shaft 126. The upper end portion 127 is shaped as a double D to receive the shredder plate assembly 118. The shredder plate assembly 118 rests on the spacer 205. A bolt 211 is used to hold the shredder plate assembly 118 to the rotatable shaft 126. To keep out debris, a rubber seal 206 slides over the steel sleeve 204 and rests in a larger portion of the central bearing pocket 165 of the upper end bell 164. A steel cap or slinger 208 is placed on top of the rubber seal 206.

The bottom of the rotatable shaft 126 is permitted to rotate relative to the lower end frame 176 by the use of bearing assembly 212. The lower bearing assembly 212 includes a housing 214 and a spherical bearing 216. The spherical bearing 216 is preferably made of powdered metal having a lubricating material.

An advantageous feature of the disposer 100 is that the use of a switched reluctance machine 180 allows the shredder plate assembly 118 to operate at different rotational speeds. A controller 220 having a feedback loop is provided to control the rotational rate of the shredder plate assembly 118. By integrating the switched reluctance machine 180 into the disposer 100, the disposer 100 overcomes several of the problems that exist in the prior art. The controller 220 has a processor or other logic unit. The same controller may be used to perform a variety of operational modes. For example, the controller 220 for the switched reluctance machine 180 can be programmed to rotate the shredder plate assembly 118 at different rotational rates to achieve certain operational modes of the present invention such as soft start mode, optimized grinding mode, idle mode, rinse mode, and anti-jamming mode.

Soft Start Mode

The present invention includes a mechanism and method of reducing a slug of food waste from entering the drainpipe. As described earlier, when conventional disposers are first turned on, the grinding plate is quickly directed to a high rotational speed. Reduced drain flow or trapped food waste may occur at the discharge outlet 162 or in the attached drainpipe when a slug of food waste is quickly forced out of the disposer at one time. This typically occurs when a user first turns on the conventional disposer after the grinding chamber 104 is filled with food waste.

Figure 6:
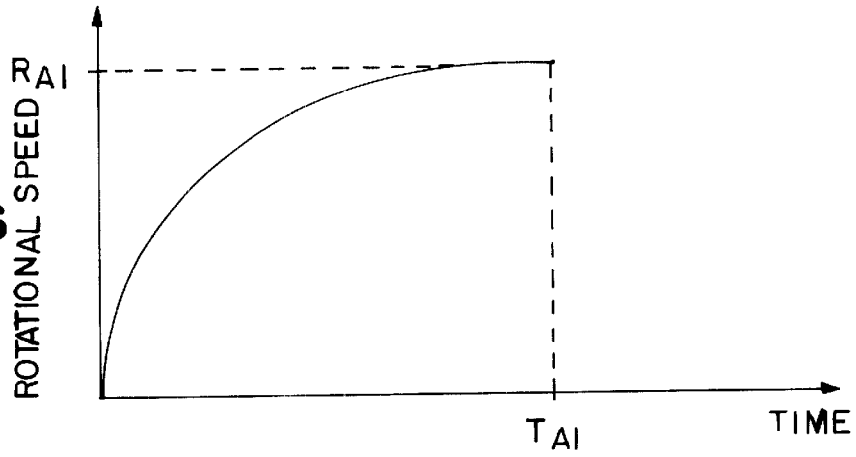
FIG. 6 is a chart for the rotational speed of the shredder plate assembly over time during the soft startup mode.

To overcome this problem, the present invention includes a method of operating a food waste disposer 100 having a variable speed motor such as a switched reluctance machine 180. The switched reluctance machine 180 is attached to the shredder plate assembly 118 to grind food waste in the grinding chamber 104. In one embodiment, at startup, the controller 220 directs the food waste disposer 100 to operate in a soft start mode. In the soft start mode, the controller activates the switched reluctance machine 180 to begin the rotation of the shredder plate assembly 118. As shown in FIG. 6, the controller is further programmed to slowly increase the rotation of the shredder plate assembly 118 to a predetermined rotational rate $R_{A1}$ over a predetermined period of time $T_{A1}$. In one embodiment, the predetermined period of time $T_{A1}$ is greater than three (3) seconds. The soft start mode also reduces the amount of noise caused by the disposer at startup.

Optimized Grinding Mode

It has been found that one speed does not optimally grind all types of food. For example, when the shredder plate assembly 118 rotates at relatively higher rotational rates such as greater than 2500 RPMs, harder food particles such as carrot fragments and bone fragments may "ride" on the shredder plate assembly 118. Riding results in increased noise and vibration, as well as, residual food left in the grinding chamber after the disposer is turned off. Over time, the residual food may cause unpleasant odors.

To overcome this issue, the present invention includes a method of operating a food waste disposer 100 having a variable speed motor such as a switched reluctance machine 180. The variable speed motor is attached to a grinding plate such as the shredder plate assembly 118 to grind food waste at different rotational rates. In one embodiment, the food waste disposer 100 operates to rotate the grinding plate at three different rotational speeds: a first rotational speed, a second rotational speed, and a third rotational speed. The first rotational speed may be a high rotational speed, the second rotational speed may be a medium rotational speed, the third rotational speed may be a low rotational speed.

At high shredder plate assembly 118 rotational speeds (for example, 2500 to 4000 RPMs), the disposer has been found to work best for reducing the material size of food waste. Rotating the grinding plate at the high rotational speeds cuts-up and breaks down the food waste material. The higher rotational speeds are particularly beneficial for stringy and fibrous foods.

At a slightly lower or medium shredder plate assembly 118 rotational speed (for example, 1500 to 2500 RPMs), the majority of food waste material is most expeditiously ground. Dense vegetables, such as carrots and potatoes, have a tendency to ride at the higher rotational speeds and are better suited for being ground at the medium rotational speed.

At the low shredder plate assembly 118 rotational speeds (for example, 300 to 1500 RPMs), the disposer has been found to work best for grinding hard foods such as bone fragments. Additionally, the lower rotational speeds permit the grinding chamber to be "cleaned out" after the size of the food waste has been reduced at the higher rotational speeds. This prevents residual food waste from remaining in the grinding chamber after the disposer is turned off.

Figure 7:
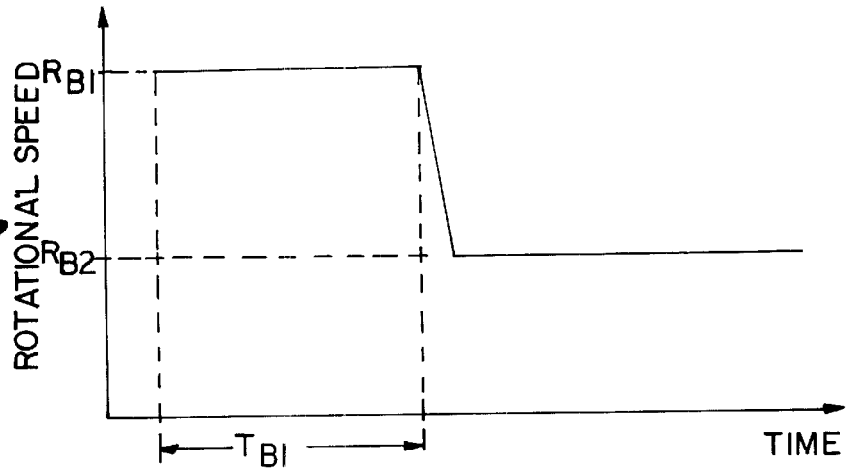
FIG. 7 is a chart for the rotational speed of the shredder plate assembly over time for one embodiment of the optimized grinding mode.

Accordingly, the present invention includes a method to grind food waste at different rotational speeds. In one embodiment, as shown in FIG. 7, the shredder plate assembly 118 of the food waste disposer 100 is rotated at a first speed $R_{B1}$ for a first period of time $T_{B1}$. The first speed $R_{B1}$ being at a relatively high rotational speed. After the first period of time $T_{B1}$, the shredder plate assembly 118 is rotated at a second speed $R_{B2}$ until the disposer is turned off. The second speed $R_{B2}$ being lower than the first speed $R_{B2}$ such as the medium or low rotational speeds described above.

Figure 8:
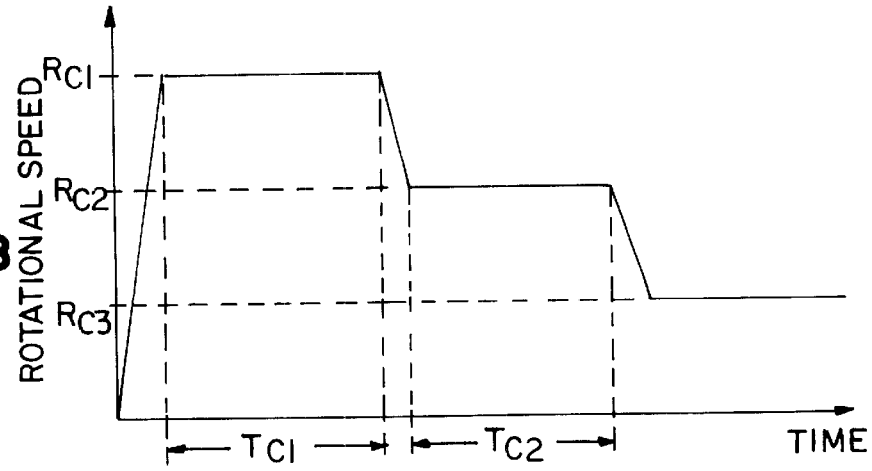
FIG. 8 is a chart for the rotational speed of the shredder plate assembly over time for another embodiment of the optimized grinding mode.

In another embodiment, as shown in FIG. 8, the shredder plate assembly 118 of the food waste disposer 100 is rotated at a first speed $R_{C1}$ for a first period of time $T_{C1}$. The first speed $R_{C1}$ also being a relatively high rotational speed. After the first period of time $T_{C1}$, the shredder plate assembly 118 is rotated at a second speed $R_{C2}$ for a second period of time $T_{C2}$. The second speed $R_{C2}$ being lower than the first speed $R_{C1}$ such as the medium rotational speed described above. The embodiment may further include rotating the shredder plate assembly 118 at a third speed $R_{C3}$ that is lower than the second speed $R_{C2}$ until the disposer is turned off.

Alternatively, after operating the disposer in an optimized grinding mode, the controller 220 may direct the disposer 100 to operate in an idle mode or rinse mode as described below.

Idle Mode

Another concern with conventional disposers is noise and power consumption. As described earlier, the typical rotational speed of the grinding plate for conventional disposers is relatively high. Higher rotational speeds produce more noise and consume more power. There may be times where the disposer is not grinding food but still turned on and running. For example, if a user is cleaning off the dinner table, there may be times when the disposer is running but no food is in the disposer. The noise caused between the times of inputting food can be distracting to the user.

Figure 9:
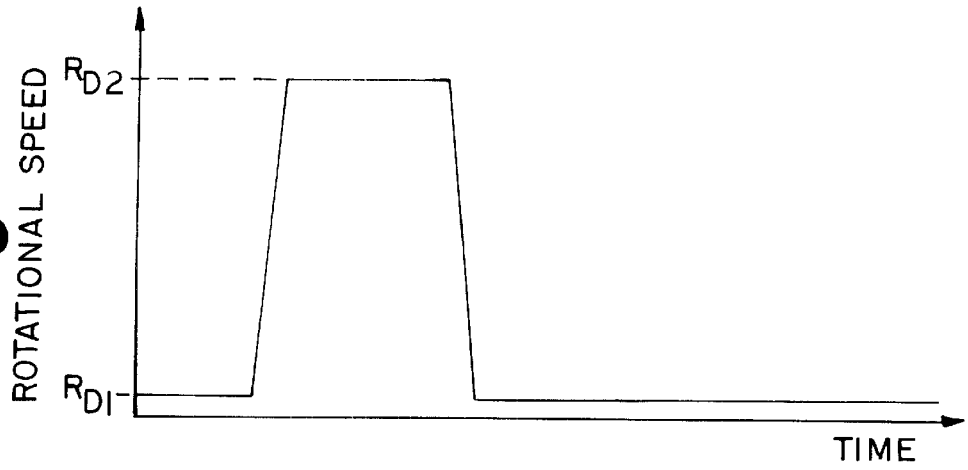
FIG. 9 is a chart for the rotational speed of the shredder plate assembly over time for one embodiment of the idle mode.

The present invention solves this problem by operating the food waste disposer 100 in idle mode. Turning to FIG. 9, during continuous feed operations, the grinding plate of the food waste disposer 100 is rotated at a reduced or idling speed $R_{D1}$. In one embodiment, the idling speed is between 400 and 800 RPMs although other rotational speeds could be used. As food is introduced into the grinding section 104, the switched reluctance machine 180 increases the rotational rate of the shredder plate assembly 118 to a higher speed $R_{D2}$ to grind the food waste. This may include running the soft startup mode or optimized grinding mode (described above). When the food waste is gone, the rotational rate of the shredder plate assembly 118 is reduced back to the idling speed.

To detect the presence of newly inserted food waste in the grinding section 104, a feedback loop is provided in the switched reluctance machine 180. The controller 220 monitors the current supplied to the switched reluctance machine 180 to rotate the shredder plate assembly 118. As food waste contacts the shredder plate assembly 118, the controller 220 will see the current increase rapidly. The reason for the increase in current is that the switched reluctance machine 180 is trying to keep the shredder plate assembly 118 at the idling speed. When it sees the increase in current, the controller 220 knows that food has been inserted into the disposer. As mentioned above, the controller 220 will then increase the rotational rate of the shredder plate assembly 118.

Rinse Mode

As mentioned above, residual food in a food waste disposer may cause unpleasant odors. Although the operational modes described above reduces the chance of residual food waste, the present invention includes a further mode to ensure the proper cleaning of the grinding chamber 104 after grinding operations. This mode is known as the rinse mode. In the rinse mode, water enters into the grinding chamber 104. Water may enter the grinding chamber 104 manually by the user by inputing water through the inlet of food conveying section 102 or automatically by providing a device similar to the dishwasher inlet 116.

Figure 10:
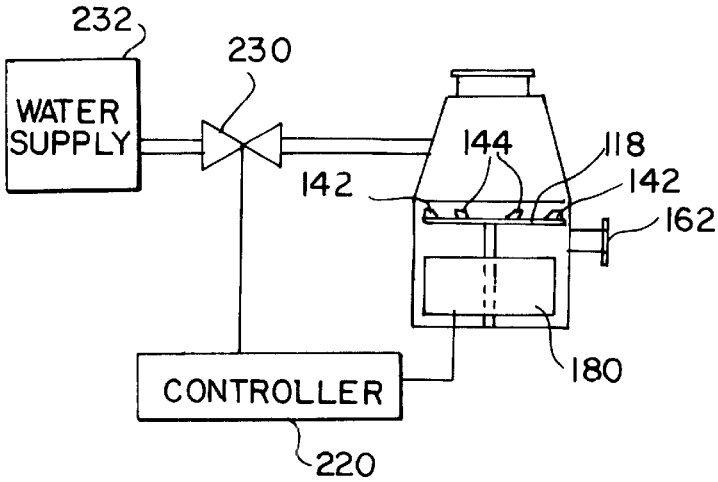
FIG. 10 is a schematic view of one embodiment of a food waste disposer for the rinse mode.

FIG. 10 illustrates one embodiment where water may be automatically injected into the grinding chamber 104. The controller 220 is electrically connected to a valve 230 and capable of electrically opening and closing the valve 230. When the valve 230 is opened, water from a pressurized source 232 is forced into the grinding chamber 104. At the time of water injection, the controller 220 increases the rotational speed of the shredder plate assembly 118 to a high rate. The increased rotational rate causes water to spread throughout the central grinding section 104. This is done by the fixed shredder lugs 142 and fixed tumbling spikes 144 of the shredder plate assembly 118 that spread the water in the central grinding section 104. The rinse mode cleans out the grinding section 104 and reduces unpleasant odors. After a predetermined period of time, the valve 230 is closed and the rotational speed of the shredder plate 118 is stopped or returned to the idle mode.

Anti-Jamming Mode

Jamming is a problem that can occur in food waste disposers. Jamming occurs when hard objects such as bones enter the food waste disposer and get stuck between the lugs of the rotating grinding plate and the teeth of the stationary shredder ring.

Accordingly, the present invention includes a food waste disposer 100 having a variable speed motor such as a switched reluctance machine 180. As described above, the controller 220 has a feedback loop that enables the controller 220 to monitor the electrical current provided to the switched reluctance machine 180. As a jam is about to occur, the rotational speed of the shredder plate assembly 118 will decrease rapidly. This will cause the electrical current to the switched reluctance machine 180 to increase sharply. In the anti-jamming mode, the controller 220 monitors the electrical current for sharp increases. When a sharp increase in current occurs, the controller 220 can take corrective action. For example, the controller 220 can instruct the switched reluctance machine 180 to increase the torque provided to the shredder plate assembly 118 from a first torque to a second torque. This may cause the object to break and continue rotating. Additionally, if the jam still exists, the controller 220 can instruct the switched reluctance machine 180 to reverse direction.

Additionally, if a jam occurs, the controller 220 may instruct the switched reluctance machine 180 to perform a series of quick backward and forward rotations in an attempt to dislodge the jammed object. Accordingly, the use of a variable speed motor in the disposer 100 can automatically detect a jam and perform corrective action.

It is contemplated that the operational modes described above may be combined or used independently. For example, at startup, the controller 220 may direct the switched reluctance machine 180 to begin a soft start mode. The controller 220 would then direct the switched reluctance machine 180 to perform the optimized grinding mode. After the optimized grinding mode, the controller 220 would direct the switched reluctance machine 180 to the idle mode for a period of time before shutting off. Before shutting off the disposer, the controller 220 could direct the disposer 100 to perform a rinse mode. Throughout the operational modes, the anti-jamming mode could run in the background and continually monitor the disposer 100 for jams. Alternatively, a keyboard or other input device could be utilized by a user to select the different operational modes of the controller.

What has been described is a food waste disposer having a variable speed motor. The use of a variable speed motor can improve the operation and performance of the food waste disposer by allowing food to be ground at different speeds. Moreover, the food waste disposer may run more efficiently with the added benefits of reduced noise, odor, and power consumption. Additionally, the food waste disposer improves grind performance and corrects jams. As described above, a switched reluctance machine is a suitable choice for the variable speed motor. The controller for the switched reluctance machine may be used to control the rotational rate of the grinding plate or shredder plate assembly. However, it is contemplated that other types of motors could be used in the present invention that permit control of the grinding plate at multiple rotational rates.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A food waste disposer, comprising:

a motor having a rotor, the motor imparting rotational movement to a rotatable shaft coupled to the rotor;

a grinding mechanism coupled to the rotatable shaft for grinding food waste; and a controller electrically coupled to the motor capable of sequentially maintaining the rotational movement of the grinding mechanism at a first rotating speed for a first period of time and a second rotating speed for a second period of time.

2. The food waste disposer of claim 1, wherein the motor is a switched reluctance motor.

3. The food waste disposer of claim 1, wherein the motor is a variable speed motor.

4. The food waste disposer of claim 1, wherein the first rotating speed is greater than the second rotating speed.

5. The food waste disposer of claim 1, wherein the first rotating speed is less than the second rotating speed.

6. The food waste disposer of claim 1, wherein the grinding mechanism comprises a shredder plate.

7. The food waste disposer of claim 6, wherein the shredder plate includes grinding lugs.

8. The food waste disposer of claim 1, wherein the motor is positioned in a motor housing section and wherein the grinding mechanism is positioned in a grinding section, and wherein the motor housing section and the grinding section are adjacent.

9. The food waste disposer of claim 8, wherein the grinding section further comprises a stationary shedder ring.

10. The food waste disposer of claim 8, further comprising a food conveying section adjacent to the grinding section for receiving food waste.

11. The food waste disposer of claim 1, wherein the controller is further capable of sequentially maintaining the rotational movement of the grinding mechanism at a third rotating speed for a third period of time.

12. The food waste disposer of claim 11, wherein the first rotating speed is greater than the second rotating speed, and the second rotating speed is greater than the third rotating speed.

13. The food waste disposer of claim 11, wherein the first rotating speed is less than the second rotating speed, and the second rotating speed is greater than the third rotating speed.

14. The food waste disposer of claim 13, wherein the first and third rotating speeds are equal.

15. The food waste disposer of claim 1, wherein motor further includes a stator, and wherein the controller is electrically coupled to the stator.

16. A food waste disposer, comprising:

a motor having a rotor, the motor imparting rotational movement to a rotatable shaft coupled to the rotor;

a grinding mechanism coupled to the rotatable shaft for grinding food waste; and a controller electrically coupled to the motor capable of controllably changing the rotational speed of the grinding mechanism to a predetermined rotational rate over a predetermined period of time.

17. The food waste disposer of claim 16, wherein the controller is capable of controllably increasing the rotational speed of the grinding mechanism to a predetermined rotational rate over a predetermined period of time.

18. The food waste disposer of claim 16, wherein the controller is capable of increasing the rotational speed of the grinding mechanism from a stationary position.

19. The food waste disposer of claim 16, wherein the motor is a switched reluctance motor.

20. The food waste disposer of claim 16, wherein the motor is a variable speed motor.

21. The food waste disposer of claim 16, wherein the grinding mechanism comprises a shredder plate.

22. The food waste disposer of claim 21, wherein the shredder plate includes grinding lugs.

23. The food waste disposer of claim 16, wherein the motor is positioned in a motor housing section and wherein the grinding mechanism is positioned in a grinding section, and wherein the motor housing section and the grinding section are adjacent.

24. The food waste disposer of claim 23, wherein the grinding section further comprises a stationary shedder ring.

25. The food waste disposer of claim 23, further comprising a food conveying section adjacent to the grinding section for receiving food waste.

26. The food waste disposer of claim 16, wherein motor further includes a stator, and wherein the controller is electrically coupled to the stator.

27. A food waste disposer having a food conveying section, comprising:

a motor having a rotor, the motor imparting rotational movement to a rotatable shaft coupled to the rotor;

a grinding mechanism coupled to the rotatable shaft for grinding food waste;

an inlet for providing water to the grinding mechanism; and a controller electrically coupled to the motor capable of changing a rotational speed of the grinding mechanism when water is provided through the water inlet.

28. The food waste disposer of claim 27, wherein the controller is capable of increasing a rotational speed of the grinding mechanism when water is provided through the water inlet.

29. The food waste disposer of claim 27, wherein the controller is capable of increasing a rotational speed of the grinding mechanism to a first rotational speed when water is provided through the water inlet.

30. The food waste disposer of claim 27, wherein the controller is capable of increasing a rotational speed of the grinding mechanism from a first rotational speed to a second rotational speed when water is provided through the water inlet.

31. The food waste disposer of claim 27, wherein the controller is capable of increasing the rotational speed of the grinding mechanism for a predetermined period of time.

32. The food waste disposer of claim 27, wherein the wherein the controller is capable of increasing the rotational speed of the grinding mechanism when water is provided through the water inlet before turning off the disposer.

33. The food waste disposer of claim 27, wherein the motor is a switched reluctance motor.

34. The food waste disposer of claim 27, wherein the motor is a variable speed motor.

35. The food waste disposer of claim 27, wherein the grinding mechanism comprises a shredder plate.

36. The food waste disposer of claim 35, wherein the shredder plate includes grinding lugs.

37. The food waste disposer of claim 27, wherein the motor is positioned in a motor housing section and wherein the grinding mechanism is positioned in a grinding section, and wherein the motor housing section and the grinding section are adjacent.

38. The food waste disposer of claim 37, wherein the grinding section further comprises a stationary shedder ring.

39. The food waste disposer of claim 37, further comprising a food conveying section adjacent to the grinding section for receiving food waste.

40. The food waste disposer of claim 27, further comprising a valve controlled by the controller for providing water to the water inlet.

41. The food waste disposer of claim 27, wherein motor further includes a stator, and wherein the controller is electrically coupled to the stator.

42. The food waste disposer of claim 27, wherein the food waste disposer further comprises a food conveying section, and wherein the inlet is different from the food conveying section.

43. A food waste disposer comprising:

an inlet for receiving food waste;

a grinding mechanism coupled to a rotatable shaft for grinding the food waste; and a variable speed motor operable to drive the grinding mechanism in a first direction to varying rotational speeds.

44. The food waste disposer of claim 43, further comprising a controller coupled to the variable speed motor capable of varying the rotational speed of the grinding mechanism.

45. The food waste disposer of claim 44, wherein the motor further comprises a stator, and wherein the controller is in electrical communication with the stator.

46. The food waste disposer of claim 45, wherein the controller is capable of controllably increasing the rotational speed of the grinding mechanism to a predetermined rotational rate over a predetermined period of time.

47. The food waste disposer of claim 46, wherein the controller is capable of increasing the rotational speed of the grinding mechanism from a stationary position.

48. The food waste disposer of claim 43, wherein the variable speed motor is capable of operating at a first speed and a second speed.

49. The food waste disposer of claim 48, wherein the variable speed motor is capable of operating at the first speed for a first time and the second speed for a second time.

50. The food waste disposer of claim 49, wherein the first and second speeds and first and second times are determined by a controller in electrical communication with the variable speed motor.

51. The food waste disposer of claim 43, wherein the motor is a switched reluctance motor.

52. The food waste disposer of claim 43, wherein the grinding mechanism includes grinding lugs.

53. The food waste disposer of claim 43, wherein the motor is positioned in a motor housing section and wherein the grinding mechanism is positioned in a grinding section, and wherein the motor housing section and the grinding section are adjacent.

54. The food waste disposer of claim 53, wherein the grinding section further comprises a stationary shedder ring.

55. The food waste disposer of claim 54, further comprising a food conveying section adjacent to the grinding section for receiving food waste.

* * * * *

UNITED STATES PATENT AND TRADEMARK OFFICE

CERTIFICATE OF CORRECTION

PATENT NO. : 6,481,652 B2 
DATED : November 19, 2002
INVENTOR(S) : William A. Strutz, Thomas R. Berger and Scott W. Anderson It is certified that error appears in the above-identified patent and that said Letters Patent is hereby corrected as shown below:

Title page,
Item [56], U.S. PATENT DOCUMENTS, delete 5,370,232, and insert -- 5,370,323 --
Item [75], Inventors, delete "William A. Strutz" and insert -- William F. Strutz --

Drawings,
Figure 3, delete "184" and insert -- 183 --

Column 8,
Line 61, delete "184" and insert -- 183 --

Column 15,
Line 51, delete "wherein the"

Signed and Sealed this

Twentieth Day of May, 2003

JAMES E. ROGAN
*Director of the United States Patent and Trademark Office*